US009222316B2

(12) United States Patent
Christie et al.

(10) Patent No.: US 9,222,316 B2
(45) Date of Patent: Dec. 29, 2015

(54) EXTENDED REACH WELL SYSTEM

(71) Applicant: Schlumberger Technology Corporation, Sugar Land, TX (US)

(72) Inventors: Richard L. Christie, Sugar Land, TX (US); Shunfeng Zheng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 390 days.

(21) Appl. No.: 13/722,944

(22) Filed: Dec. 20, 2012

(65) Prior Publication Data

US 2014/0174722 A1 Jun. 26, 2014

(51) Int. Cl.
*E21B 43/00* (2006.01)
*E21B 17/10* (2006.01)

(52) U.S. Cl.
CPC ..... *E21B 17/1078* (2013.01); *E21B 17/1007* (2013.01); *E21B 43/00* (2013.01)

(58) Field of Classification Search
CPC . E21B 17/10; E21B 17/1078; E21B 17/1021; E21B 17/1007; E21B 17/1028; E21B 19/22; E21B 17/1014; E21B 43/103
USPC ..... 166/241.6, 241.1, 380, 381, 242.6, 378, 166/77.2
See application file for complete search history.

(56) References Cited

U.S. PATENT DOCUMENTS

| | | | | |
|---|---|---|---|---|
| 3,155,163 | A | | 11/1964 | Bodine |
| 4,384,625 | A | | 5/1983 | Roper et al. |
| 4,574,888 | A | | 3/1986 | Vogen |
| 4,576,229 | A | | 3/1986 | Brown |
| 4,667,742 | A | | 5/1987 | Bodine |
| 4,776,397 | A | * | 10/1988 | Akkerman ..... 166/241.5 |
| 4,890,682 | A | | 1/1990 | Worrall et al. |
| 4,913,234 | A | | 4/1990 | Bodine |
| 5,448,911 | A | | 9/1995 | Mason |
| 5,785,125 | A | * | 7/1998 | Royer ..... 166/380 |
| 6,009,948 | A | | 1/2000 | Flanders et al. |

(Continued)

FOREIGN PATENT DOCUMENTS

| | | | |
|---|---|---|---|
| GB | 2275342 | A | 8/1994 |
| WO | 9735093 | A1 | 9/1997 |
| WO | 2010125405 | A2 | 11/2010 |

OTHER PUBLICATIONS

Castaneda, et al., "Coiled Tubing Milling Operations: Successful Application of an Innovative Variable Water Hammer Extended-Reach BHA to Improve End Load Efficiencies of a PDM in Horizontal Wells", SPE 143346—SPE/ICoTA Coiled Tubing Conference & Well Intervention Conference and Exhibition, The Woodlands, Texas, USA, Apr. 5-6, 2011, pp. 1-19.

(Continued)

*Primary Examiner* — Daniel P Stephenson
(74) *Attorney, Agent, or Firm* — Michael L. Flynn; Timothy Curington; Robin Nava

(57) ABSTRACT

A system and methodology facilitates extending the reach of coiled tubing during a well operation. The technique employs tubing which is deployed along wellbore. A plurality of extended reach devices is positioned along the tubing. Each extended reach device has at least one internal guide member oriented for extension into an interior of the tubing. The guide member engages and guides the coiled tubing during movement of the coiled tubing along the interior of the tubing, thus enabling an extended reach during a wellbore servicing application.

19 Claims, 3 Drawing Sheets

(56) References Cited

U.S. PATENT DOCUMENTS

| | | | | |
|---|---|---|---|---|
| 6,135,206 | A * | 10/2000 | Gano et al. | 166/297 |
| 6,412,560 | B1 | 7/2002 | Bernat | |
| 6,439,318 | B1 | 8/2002 | Eddison et al. | |
| 6,464,014 | B1 | 10/2002 | Bernat | |
| 6,550,536 | B2 | 4/2003 | Bernat | |
| 6,571,870 | B2 | 6/2003 | Zheng et al. | |
| 6,845,818 | B2 | 1/2005 | Tutuncu et al. | |
| 6,907,927 | B2 | 6/2005 | Zheng et al. | |
| 7,139,219 | B2 | 11/2006 | Kollé et al. | |
| 7,219,726 | B2 | 5/2007 | Zheng et al. | |
| 7,575,051 | B2 | 8/2009 | Stoesz et al. | |
| 7,637,321 | B2 | 12/2009 | Zazovsky et al. | |
| 7,708,088 | B2 | 5/2010 | Allahar et al. | |
| 7,757,793 | B2 | 7/2010 | Voronin et al. | |
| 7,874,362 | B2 | 1/2011 | Coates et al. | |
| 8,042,623 | B2 | 10/2011 | Quernheim et al. | |
| 8,636,062 | B2 | 1/2014 | Fripp et al. | |
| 2005/0284624 | A1 | 12/2005 | Libby et al. | |
| 2006/0054315 | A1 | 3/2006 | Newman | |
| 2007/0256828 | A1 | 11/2007 | Birchak et al. | |
| 2008/0073085 | A1 | 3/2008 | Lovell et al. | |
| 2008/0115972 | A1* | 5/2008 | Lynde et al. | 175/57 |
| 2008/0251254 | A1 | 10/2008 | Lynde et al. | |
| 2009/0314486 | A1* | 12/2009 | Castro | 166/241.6 |
| 2010/0276204 | A1 | 11/2010 | Connell et al. | |
| 2011/0203395 | A1 | 8/2011 | Pfahlert | |
| 2011/0267922 | A1 | 11/2011 | Shampine et al. | |
| 2012/0024539 | A1* | 2/2012 | Lehr | 166/381 |
| 2012/0186808 | A1* | 7/2012 | Lively et al. | 166/241.6 |
| 2012/0318531 | A1 | 12/2012 | Shampine et al. | |
| 2014/0174722 | A1* | 6/2014 | Christie et al. | 166/241.1 |
| 2014/0251639 | A1* | 9/2014 | Jewett | 166/382 |
| 2015/0034336 | A1* | 2/2015 | Morrison et al. | 166/381 |

OTHER PUBLICATIONS

Dupriest, et al., "Design Methodology and Operation Practices Eliminate Differential Sticking," SPE 128129—IADC/SPE Drilling Conference and Exhibition, New Orleans, Louisiana, USA, 2010, pp. 1-13.

Newman, Kenneth R., "Vibration and Rotation Considerations in Extending Coiled-Tubing Reach," SPE 106979—SPE/ICoTA Coiled Tubing and Well Intervention Conference and Exhibition, The Woodlands, Texas, U.S.A., 2007, pp. 1-9.

Robertson, et al., "Dynamic Excitation Tool: Developmental Testing and CTD Field Case Histories," SPE 89519—SPE/ICoTA Coiled Tubing Conference and Exhibition, Houston, Texas, Mar. 23-24, 2004, pp. 1-16.

Sola, Kjell-Inge, "New Downhole Tool for Coiled Tubing Extended Reach," SPE 60701—SPE/ICoTA Coiled Tubing Roundtable, Houston, Texas, Apr. 5-6, 2000, 8 pages.

Stoesz, et al., "Low-Frequency Downhole Vibration Technology Applied to Fishing Operations," SPE 63129—SPE Annual Technical Conference and Exhibition, Dallas, Texas, 2000, pp. 1-7.

Underhill, William B., "A Predictive Model for Wireline Tool Sticking," SWS-HPC, Engineering Report: Advanced Studies Engineering Report #17, Jun. 19, 1997, 40 pages.

* cited by examiner

EXTENDED REACH WELL SYSTEM

BACKGROUND

Coiled tubing has been used in well servicing applications in various wells, but many such wells have not been properly serviced due to the rather limited extended reach capability of coiled tubing. Certain technologies have been considered for extending the reach of coiled tubing. For example, downhole vibration technologies can help improve the reach of coiled tubing in well servicing applications. Additionally, downhole tractor technology can be used to generate a downhole pull force which increases the extended reach of the coiled tubing. Downhole tractors are generally electrically or hydraulically powered and can generate pull forces on the order of 1000 pounds for electric tractors and 2000-7000 pounds for hydraulic downhole tractors. However, such techniques have proven to be limited in providing sufficient extended reach capability in a variety of well applications.

SUMMARY

In general, the present disclosure provides a system and method for extending the reach of coiled tubing during a well operation. The technique employs a tubing which is deployed along or within a wellbore. A plurality of extended reach devices is positioned along the tubing. Each extended reach device may have at least one internal guide member oriented for extension into an interior of the tubing. The guide member or guide members engage and guide the coiled tubing during movement of the coiled tubing along the interior of the surrounding tubing to enable an extended reach during a wellbore servicing application.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
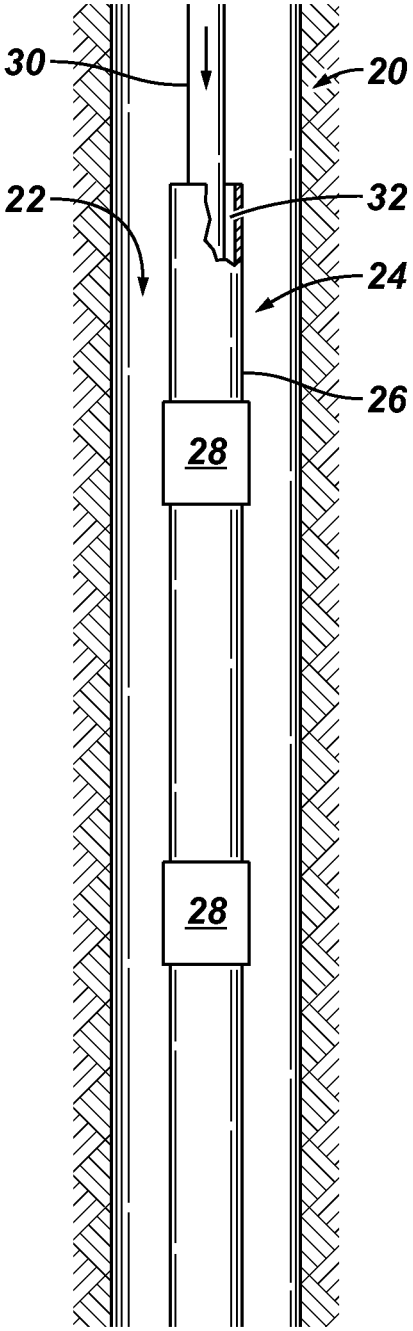
FIG. 1 is a schematic illustration of a well system comprising a tubing and a plurality of extended reach devices deployed along the tubing in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology that relate to extending the reach of coiled tubing in well applications. Embodiments of the methodology comprise completing an extended reach well in a manner which anticipates extending the reach of a conveyance such as coiled tubing deployed in the well during, for example, a service application. Extended reach devices are deployed along a wellbore in cooperation with tubing, such as completion tubing. The extended reach devices are designed to enhance the reach of coiled tubing deployed down through the surrounding tubing and through the extended reach devices. Depending on the application, the extended reach devices may be installed in an active configuration or they may be designed for actuation on demand to facilitate the extended reach of the coiled tubing. As defined herein, an extended reach device comprises any device or devices that provide for further advancement of a conveyance such as coiled tubing within the wellbore including, but not limited to, a device for facilitating axial movement of the conveyance by reducing the friction, and/or delaying the onset of buckling that would otherwise be incurred by the conveyance during axial movement through the interior of the tubing string.

In several well related applications, the technique involves completing a well in a manner which facilitates the extended reach of coiled tubing via strategic placement of extended reach devices along a completion string. The extended reach devices may comprise a variety of components to reduce the axial friction acting on the coiled tubing as it is conveyed along an interior of the completion string. Examples of friction reducing components comprise rollers, internal centralizers, bow springs, anisotropic friction members, vibrators, rotators, and other devices which reduce friction in an axial direction between the coiled tubing and a surrounding tubing, and/or delay the occurrence of helical buckling within the wellbore. In some applications, the friction reducing components have anisotropic friction properties in which a higher friction coefficient is provided in the circumferential direction relative to the axial direction to delay buckling, such as helical buckling, of the coiled tubing. The extended reach devices and their friction reducing components may be in the form of static features in the completion string or they may be designed for activation on demand. Additionally, the extended reach devices may be used with or without other supplemental technologies to extend the coiled tubing reach. Examples of supplemental technologies include downhole tractors, downhole vibrators on the coiled tubing, and other suitable technologies.

In a specific embodiment, the technique utilizes a tubing which is deployed along and/or within a wellbore. Extended reach devices are positioned along the tubing at selected locations to enhance the reach of coiled tubing conveyed along the interiors of the devices. Each extended reach device has a friction reducing component in the form of at least one internal guide member oriented for extension into an interior of the tubing. The guide member or guide members engage and guide the coiled tubing during movement of the coiled tubing along the interior of the tubing to enable an extended reach during a wellbore servicing application.

Referring generally to FIG. 1, an embodiment of a well system for increasing the reach of coiled tubing in a well is illustrated. By way of example, the well system may comprise many types of components and may be employed in many types of applications and environments, including cased wells and open-hole wells. The well system also may be utilized in vertical wells and deviated wells, e.g. horizontal wells. In some applications, the well system comprises a well completion designed to facilitate a specific well related application.

In the example of FIG. 1, a well system 20 is illustrated as deployed in a wellbore 22. The well system 20 comprises a tubing string 24 having a tubing 26 extending along and/or within the wellbore 22. In at least some applications, the tubing string 24 is part of a downhole well completion. A plurality of extended reach devices 28 is positioned along the tubing string 24 and serves to extend the reach of a coiled tubing 30 which is conveyed along an interior 32 of tubing string 24. In the example illustrated, two extended reach devices 28 are deployed along tubing 26 at unique locations, however additional extended reach devices 28 (and sometimes numerous extended reach devices 28) may be deployed along the tubing 26. The devices 28 function to, for example, reduce the axial friction acting on the coiled tubing 30 and to support the coiled tubing 30 against buckling as it is conveyed along interior 32 of tubing 26. Depending on the curvature of the wellbore, the specific servicing application (or other well application), and the size of the coiled tubing 30 and surrounding tubing 26, the spacing between extended reach devices 28 along tubing 26 may be selected to enhance the extended reach of the coiled tubing 30 through tubing 26.

Figure 2:
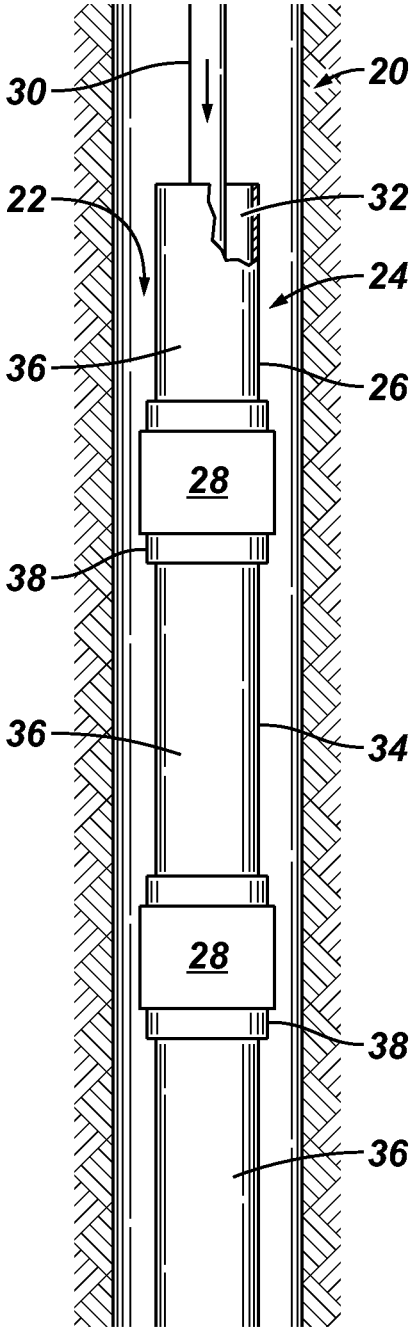
FIG. 2 is a schematic illustration of a well system comprising a tubing in the form of casing with a plurality of extended reach devices deployed along the casing in a wellbore, according to an embodiment of the disclosure.

In some applications, tubing string 24 comprises tubing 26 in the form of well casing 34, as illustrated in the embodiment of FIG. 2. In this example, the tubing string 24 is a well completion comprising casing 34 and has a plurality of the extended reach devices 28 disposed along the well casing 34. By way of example, the well casing 34 may comprise a plurality of casing sections 36 connected by casing collars 38. In some embodiments, the extended reach devices 28 are combined with and/or integrated with corresponding casing collars 38 along the overall casing/completion string. As utilized herein, the term "completion string" may comprise tubing and/or casing to which extended reach devices 28 are attached.

Referring again to FIG. 2, each extended reach device 28 may be built as part of a corresponding casing collar 38, or the extended reach devices 28 may be built as separate components which may be selectively connected to the casing sections 36 and/or to casing collars 38. In some applications, the extended reach devices 28 may be mounted entirely within the tubing 26, e.g. within casing 34. The number of extended reach devices 28, the placement of those devices, and the spacing between extended reach devices is selected to enhance movement of the coiled tubing 30 along the interior 32. For example, the extended reach devices 28 may be strategically placed along the well casing 34 with sufficiently short intervals between and/or according to the specific profile of wellbore 22 to help maximize the extended reach of the coiled tubing 30 by preventing buckling, such as helical buckling, or by limiting the potential for buckling of the coiled tubing. Alternatively, the extended reach devices 28 may be placed in the lower end of the vertical section of the casing string to help delay the occurrence of helical buckling.

In embodiments described herein, extended reach devices 28 may each comprise a guide member or a plurality of guide members positioned along the interior of the extended reach device 28. For example, some embodiments of extended reach device 28 utilize a guide member or a plurality of guide members which are oriented to extend into an interior of the extended reach device 28 and thus into an interior of the tubing string 24. The guide members may be static, or the guide members may be subject to actuation so they may be selectively controlled and actuated between a radially outward position and a radially inward position located farther into the interior 32. By way of examples, the guide members may comprise rollers, internal centralizers, bow springs, anisotropic friction members, vibrators, e.g. longitudinal or lateral vibrators, rotators, and other suitable guide members.

Figure 3:
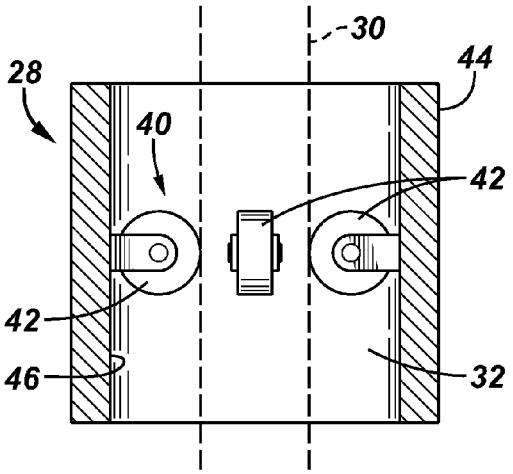
FIG. 3 is an illustration of an example of an extended reach device having at least one guide member oriented to extend into a tubing interior, according to an embodiment of the disclosure.

Referring generally to FIG. 3, an example of extended reach device 28 is illustrated in cross-section to show a guide member 40. The guide member 40 may be an individual guide member or a plurality of guide members depending on the design of the extended reach device 28 and/or guide member (s) 40. In the example of FIG. 3, the illustrated guide member 40 comprises at least one guide feature in the form of a roller 42 oriented to roll axially along coiled tubing 30 (shown in dashed lines) as the coiled tubing 30 is conveyed along interior 32 of the extended reach devices 28 and of the overall tubing string 24. For example, the guide member 40 may comprise a plurality of rollers 42 rotatably mounted along a housing 44, e.g. a tubing section, of the extended reach device 28. In some applications, the rollers 42 extend inwardly from an interior surface 46 of housing 44. As with various other types of guide members 40 described herein, the rollers 42 support the coiled tubing 30 along the interior 32 at a predetermined spacing from interior surface 46, thus reducing friction with respect to movement of coiled tubing 30 in an axial direction along interior 32, and/or delay the occurrence of helical buckling.

The spacing between extended reach devices 28 along tubing string 24 and the support provided by rollers 42 enhance the reach of coiled tubing 30 during downhole servicing operations and/or other well related operations. For example, rollers 42 are oriented to reduce the clearance between the tubing string 24, e.g. completion string, and the coiled tubing 30, thus increasing the buckling load of the coiled tubing. The ability to incur greater loading on the coiled tubing delays the occurrence of coiled tubing helical buckling, thus allowing extension of the coiled tubing reach as it is conveyed down through interior 32. Additionally, the rollers 42 reduce friction between the coiled tubing 30 and the surrounding tubing string 24, thus further delaying the occurrence of coiled tubing helical buckling and further increasing the reach of the coiled tubing.

The rollers 42 may be mounted in a fixed position extending inwardly into interior 32. In other embodiments, however, the rollers 42 may be shifted between radially outward and radially inward positions. For example, the rollers 42 may be foldable or otherwise articulatable such that the rollers may be folded to a radially outward position, e.g. into a recess formed in housing 44, to permit more open flow along interior 32. During a coiled tubing servicing operation, however, the rollers 42 may be activated to a radially inward position to facilitate conveyance, and thus the extended reach, of coiled tubing 30 along the interior 32. As described in greater detail below, activation of the rollers 42 may be accomplished by a variety of suitable techniques, including pressurized fluid activation, using one or a plurality of separate control lines from the surface or by combining or suitably equipping the coiled tubing 30 with an activation tool designed to engage and activate the rollers 42 or other type of guide members 40.

Figure 4:
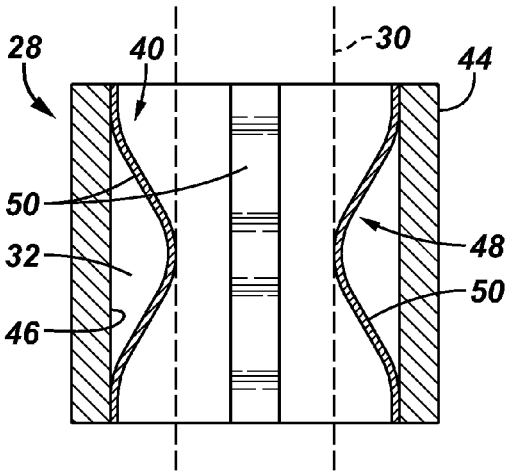
FIG. 4 is an illustration of another example of an extended reach device having at least one guide member oriented to extend into a tubing interior, according to an embodiment of the disclosure.

Referring generally to FIG. 4, another embodiment of extended reach device 28 is illustrated. In this embodiment, the extended reach device 28 comprises guide member 40 in the form of a centralizer 48. The centralizer 48 extends inwardly from interior surface 46 and into interior 32 for engagement with coiled tubing 30. Centralizer 48 may comprise a variety of guide features designed to guide the coiled tubing and to facilitate the reach of coiled tubing 30. However, the illustrated example utilizes guide features in the form of a plurality of bow springs 50. By way of example, the bow springs 50 may be attached to housing 44, e.g. to interior surface 46, and oriented to extend inwardly into interior 32.

Similar to the action of rollers 42, the centralizer 48 reduces the clearance between the coiled tubing 30 and the surrounding tubing 26, thus increasing the loading threshold of the coiled tubing 30 that would cause buckling of the coiled tubing 30. As a result, the occurrence of helical buckling is delayed and more axial force may be applied to the coiled tubing to extend the reach of the coiled tubing 30. If bow springs 50 are employed, the springs may be mounted in a static configuration or they may be designed for deployment between a retracted and an activated position. For example, the bow springs 50 may be retracted, e.g. folded, into a recess to reduce restriction to fluid flow and to facilitate the passing of bottom hole assemblies. The bow springs 50 may then be selectively activated to an inwardly extended position for engagement with coiled tubing 30 to help extend the reach of the coiled tubing 30.

Figure 5:
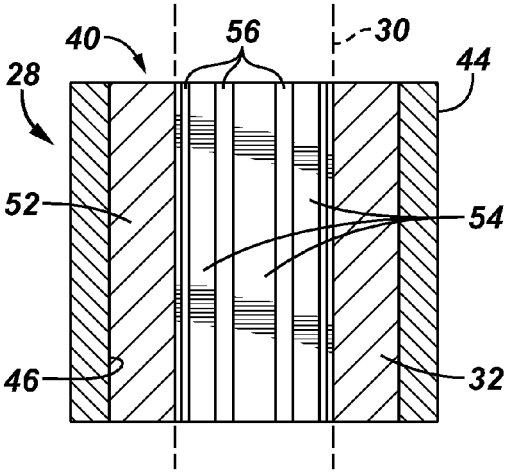
FIG. 5 is an illustration of another example of an extended reach device having at least one guide member oriented to extend into a tubing interior, according to an embodiment of the disclosure.

Referring generally to FIG. 5, another embodiment of extended reach device 28 is illustrated. In this embodiment, the extended reach device 28 comprises guide member 40 in the form of an anisotropic device 52. The anisotropic device 52 is designed to have a friction coefficient in a circumferential direction which is relatively higher than the friction coefficient in a longitudinal or axial direction. An example of anisotropic device 52 comprises a plurality of axially/longitudinally oriented ribs 54 or other guide features disposed to extend radially inwardly. The ribs 54 are separated by axially/longitudinally oriented grooves 56. In some embodiments, the ribs 54 may be created by machining or otherwise forming the grooves 56 along the interior of housing 44. In other applications, however, the ribs may be mounted along interior surface 46 of housing 44 via appropriate attachment methods, e.g. via welding, adhering, fasteners, and/or other suitable attachment methods. In yet other applications, the ribs may be just a pattern of surface coatings that yield different friction coefficients in axial (longitudinal) direction from circumferential direction. By forming anisotropic device 52 with a friction coefficient in the circumferential direction higher than in the longitudinal direction, helical buckling of the coiled tubing 30 is delayed to facilitate extended reach of the coiled tubing 30.

Figure 6:
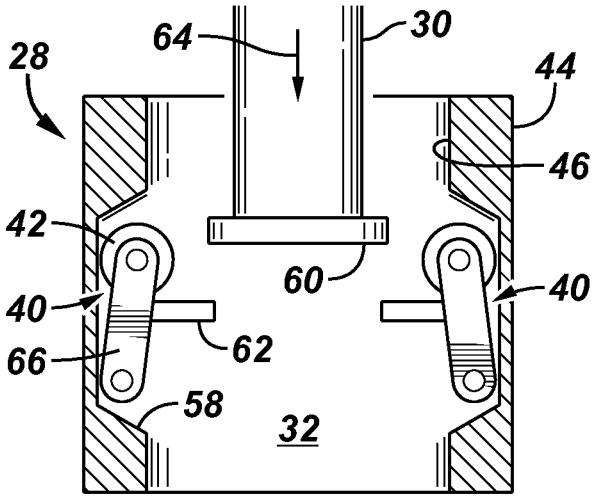
FIG. 6 is an illustration of another example of an extended reach device having at least one guide member oriented for extension into a tubing interior, according to an embodiment of the disclosure.
Figure 7:
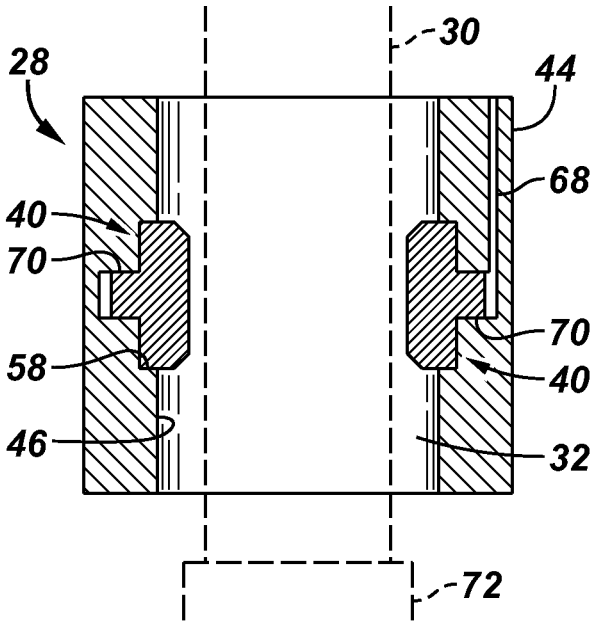
FIG. 7 is an illustration of another example of an extended reach device having at least one guide member oriented for extension into a tubing interior, according to an embodiment of the disclosure.

Referring generally to FIGS. 6 and 7, additional embodiments of extended reach devices 28 are illustrated. In these embodiments, the extended reach devices 28 comprise guide members 40 which may be activated between radially outward and radially inward positions. As discussed above, various types of actuating mechanisms and systems may be used with various types of guide members 40, such as rollers 42, bow springs 50, ribs 54, and/or other types of guide members. For example, actuating mechanisms may be combined with any of the embodiments described above.

In the embodiment illustrated in FIG. 6, the guide member 40 may be selectively moved between a radially outward position and a radially inward position. In the radially outward position, the guide member 40 is at least partially received in a recess 58 formed in housing 44; and in the radially inward position, the guide member extends inwardly into interior 32 for engagement with coiled tubing 30. In this example, the guide members 40 may comprise ribs, centralizers, rollers 42, or other suitable guide members that may be selectively activated. Activation may be achieved with an activation tool 60, e.g. a shifting tool, mounted on coiled tubing 30. In the example illustrated, activation tool 60 is mounted on a lead end of the coiled tubing and is designed for engagement with corresponding engagement features 62 on guide members 40. As the activation tool 60 is moved into contact with engagement features 62 and then past the guide member 40, the guide member 40 is shifted to another position. For example, as activation tool 60 and coiled tubing 30 are moved down through the tubing string 24 past the extended reach device 28 in the direction indicated by arrow 64, the guide features, e.g. rollers 42, of guide member 40 are extended inwardly. In the embodiment illustrated, the guide features are pivoted on pivot arms 66 (or otherwise shifted) radially inward into engagement with coiled tubing 30. Once shifted to this radially inward position, the extended reach devices 28 and their guide members 40 function as described above to extend the reach of the coiled tubing 30 during, for example, a well servicing operation. The activation tool may be designed to also serve as de-activation tool. This way, when the coiled tubing is retrieved from the well (POOH), the retrieving of the activation tool passing the extended reach devices will deactivate the extended reach devices, i.e., shifting the devices into the recess (or radially outward) position.

Various other actuation techniques may be employed to shift the guide members 40 between radially outward positions and engaged, radially inward positions. Referring generally to FIG. 7, the guide member 40 is again illustrated as movable between a radially outward position and a radially inward position. In the radially outward position, the guide member 40 may be received in recesses, e.g. recesses 58 formed in housing 44. When shifted toward the radially inward position, the guide member 40 is selectively moved to extend inwardly into interior 32 for engagement with coiled tubing 30. Each guide member 40 is shifted via a control input delivered through a control line 68.

By way of example, the control line 68 may be a fluid control line for delivering pressurized fluid. In this embodiment, hydraulic fluid or another suitable fluid may be selectively delivered under pressure to a piston or other movable member 70 which shifts the guide member or guide members 40 to the radially inward position for engagement with coiled tubing 30, as illustrated. The guide members 40 may again comprise ribs, centralizers, rollers, or other suitable guide members that may be selectively activated via activation signals supplied through control line 68. In some embodiments, control line 68 may comprise an electrical control line, fiber-optic control line, or another type of suitable control line able to deliver control signals to an actuator which controls the movement of guide members 40 between the radially outward and radially inward positions.

Depending on the environment and application, the extended reach devices 28 may be used in cooperation with other technologies to increase or otherwise facilitate the extended reach of the coiled tubing. For example, additional devices 72 (see FIG. 7) may be used to help extend the reach of the coiled tubing during, for example, a treatment application or other servicing application. Examples of devices 72 comprise downhole tractors and downhole vibrators. In an embodiment, the extended reach devices 28 may be used in cooperation with friction reducers pumped from the surface into the interior 32 of tubing string 24 between the tubing string 24 and the coiled tubing 30.

In some applications, additional or other components also may be combined with the overall well system to facilitate the extended reach of the coiled tubing. Various materials, configurations, and/or features may be integrated into the extended reach devices 28 and/or into other portions of the overall system to facilitate enhanced reach. For example, the coiled tubing 30 may be modified so that its outside surface exhibits anisotropic friction properties, e.g. modified to utilize friction coefficients that are higher in the circumferential direction than in the axial direction. The higher friction in the circumferential direction and the lower friction in the axial direction reduces the tendency toward helical buckling of the coiled tubing 30 within the larger tubing 26, thus increasing the reach of the coiled tubing 30.

Depending on the application and/or environment in which the well system 20 is employed, the overall system may have many forms and configurations. The well system 20 may utilize a variety of tubular structures forming portions of many types of well completions. In many applications, the tubing may be in the form of casing although other types of tubular structures may be combined with the extended reach devices to facilitate conveyance of coiled tubing over greater distances therethrough. In an embodiment, the extended reach devices may be activated by running the activation tool into the well, and be deactivated by retrieving the activation tool from the well. In an embodiment, a command via a control line from the surface is transmitted to activate or deactivate the extended reach devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for extending the reach of coiled tubing during a well operation, comprising:

a completion string deployed along a wellbore wherein the completion string comprises well casing and a plurality of casing collars; and a plurality of extended reach devices positioned along the completion string, to facilitate extending the reach of the coiled tubing during movement of the coiled tubing along the interior of the completion string, wherein each of extended reach devices is mounted at a corresponding casing collar of the plurality of casing collars.

2. The system as recited in claim 1, wherein the extended reach devices are formed as separate components attached to the well casing.

3. The system as recited in claim 1, wherein at least one of the extended reach devices comprises a guide member oriented for extension into an interior of the completion string for engagement with the coiled tubing in a manner to extend the reach.

4. The system as recited in claim 3, wherein the guide member is selectively actuatable between a radially outward position and a radially inward position for engagement with the coiled tubing.

5. The system as recited in claim 3, wherein each guide member facilitates axial movement of the coiled tubing by reducing the friction that would otherwise be incurred by the coiled tubing during axial movement through the interior of the completion string.

6. The system as recited in claim 3, wherein the guide members comprises at least one of a plurality of rollers, a plurality of centralizers, a plurality of bow springs, and a plurality of axially oriented ribs separated by grooves.

7. The system as recited in claim 1, wherein at least one of the extended reach devices has anisotropic friction properties with a relatively high friction coefficient in the circumferential direction compared to the friction coefficient in the axial direction.

8. The system as recited in claim 1, wherein the extended reach devices are positioned in a predetermined location, the predetermined location comprising at least one of a location where helical buckling of coiled tubing is likely to occur.

9. The system as recited in claim 1, further comprising at least one of a tractor and a vibrator attached to the coiled tubing string.

10. A method for extending the reach of coiled tubing during a well operation, comprising:

positioning a plurality of extended reach devices along a completion string;

deploying the completion string and the extended reach devices along a wellbore;

conveying a coiled tubing string into the completion string in the wellbore; and using the plurality of extended reach devices to support coiled tubing against buckling by selectively actuating the extended reach devices to extend into the interior of the completion string by an activating tool on the coiled tubing string and/or a command sent via a control line from a well surface to provide a low friction surface against which the coiled tubing moves longitudinally as the coiled tubing is conveyed along an interior of the completion string.

11. The method as recited in claim 10, wherein using comprises employing at least one of a plurality of rollers, a plurality of bow springs, a plurality of centralizers, and a plurality of axially oriented ribs separated by grooves in the extended reach devices.

12. The method as recited in claim 10, further comprising retrieving the coiled tubing string to the well surface; and deactivating the extended reach devices to retract away from the interior of the completion string while retrieving.

13. The method as recited in claim 10, where positioning comprises placing the extended reach devices on the completion string where helical buckling of coiled tubing is likely to occur.

14. The method as recited in claim 10, wherein using comprises providing a guide member oriented for extension into an interior of the completion string for engagement with the coiled tubing in a manner to extend the reach.

15. The method as recited in claim 10, wherein using further comprises comprising using at least one of a tractor attached to the coiled tubing string, and/or a vibrator attached to the coiled tubing string to convey the coiled tubing string, and/or applying a pressure pulse to the coiled tubing string, and/or disposing friction reducers in an annulus formed between the completion string and the coiled tubing.

16. A wellbore system, comprising:

a plurality of extended reach devices positioned at predetermined locations along a completion string deployed in a well to extend the reach of a conveyance deployed through an interior of the completion string, wherein at least one of the extended reach devices has anisotropic friction properties with a relatively high friction coefficient in the circumferential direction compared to the friction coefficient in the axial direction.

17. The system as recited in claim 16, wherein the extended reach devices comprise at least one guide member extending into the interior of the completion string to support the conveyance at a position offset from an interior surface of the completion string.

18. The system as recited in claim 16, wherein the conveyance comprises coiled tubing and plurality of the extended reach devices are separated by predetermined locations selected to reduce the potential for buckling of the coiled tubing.

19. The system as recited in claim 16, wherein the guide members are selectively extendable into the interior of the completion string, wherein the guide members are activated to extend into the interior of the completion string and deactivated to retract away from the interior of the completion string by at least one of an actuating tool in a conveyance deployed in the wellbore and/or a command sent via a control line from the well surface.

* * * * *